United States Patent [19]

Mucha et al.

[11] Patent Number: 4,785,147

[45] **Date of Patent: * Nov. 15, 1988**

[54] SYSTEM FOR HARDENING GEARS BY INDUCTION HEATING

[75] Inventors: George M. Mucha, Parma Hts., Ohio; George D. Pfaffmann, Farmington; Donald E. Novorsky, Pleasant Ridge, both of Mich.

[73] Assignee: Tocco, Inc., Boaz, Ala.

[ * ] Notice: The portion of the term of this patent subsequent to Jun. 23, 2004 has been disclaimed.

[21] Appl. No.: 106,537

[22] Filed: Oct. 7, 1987

Related U.S. Application Data

[60] Continuation of Ser. No. 23,564, Mar. 9, 1987, Pat. No. 4,749,834, which is a division of Ser. No. 878,186, Jun. 25, 1986, Pat. No. 4,675,488.

[51] Int. Cl.[4] ..... H05B 6/14

[52] U.S. Cl. ..... 219/10.59; 219/10.71; 219/10.77; 266/125; 266/129

[58] Field of Search ..... 219/10.59, 10.57, 10.41, 219/10.43, 10.71, 10.75, 10.77; 266/124, 125, 126, 129; 148/147, 148, 150, 152

[56] References Cited

U.S. PATENT DOCUMENTS

| | | | |
|---|---|---|---|
| 2,167,798 | 8/1939 | Denneen et al. | 219/10.59 X |
| 2,444,259 | 6/1948 | Jordan | 219/10.77 |
| 2,590,546 | 3/1952 | Kincaid et al. | 219/10.59 |
| 2,689,900 | 9/1954 | Redmond et al. | 219/10.75 |
| 3,446,495 | 5/1969 | Pfaffmann et al. | 266/129 |
| 4,251,704 | 2/1981 | Masie et al. | 219/10.59 |
| 4,363,946 | 12/1982 | Busemann | 219/10.59 |
| 4,675,488 | 6/1987 | Mucha | 219/10.43 |

*Primary Examiner*—Philip H. Leung

*Attorney, Agent, or Firm*—Body, Vickers & Daniels

[57] ABSTRACT

An apparatus for hardening the outwardly facing teeth surfaces of a gear is disclosed. First and second induction heating coils with power sources controlled by an appropriate microprocessor heat the gear when in the first coil at a precisely controlled cycle to generate an unstable, circular band of high temperature positioned radially inwardly from the tips of the gear. Before the band can dissipate, the microprocessor actuates an appropriate drive to locate the gear in the second coil energized by an appropriate power source to impart a high skin temperature to the teeth. A liquid spray quench in the second coil is immediately actuated to effectively quench the gear. By sizing the cycles, the apparatus is thus able to rapidly harden the gear teeth at minimal power levels.

7 Claims, 10 Drawing Sheets

FIG. 6A
(TOP)
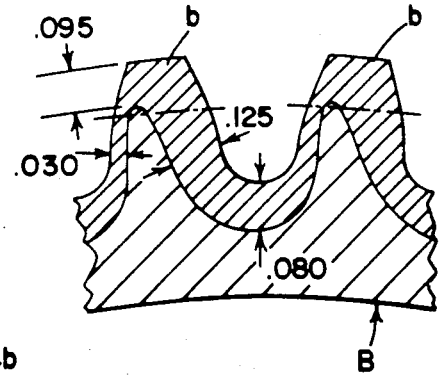
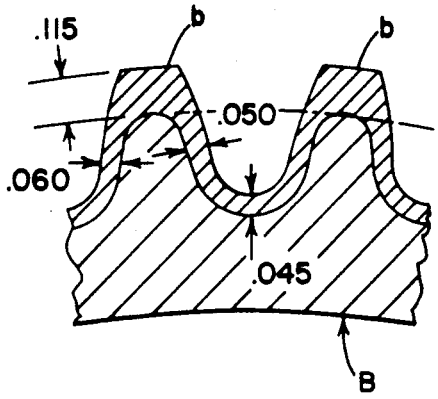
FIG. 6B
(MIDDLE)
(AVG. DEPTH TO RC 50 IN INCHES)
FIG. 6C
(BOTTOM)
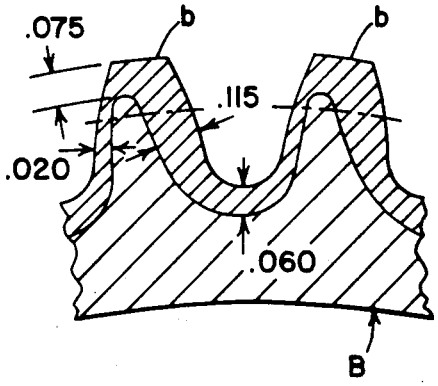
FIG. 6D
HARDENING CYCLE
1. 1ST PREHEAT – 210 KW, 1KHz 5 SECONDS.
2. DELAY TIME – 25 SECONDS.
3. 2ND PREHEAT – 210 KW, 1KHz 3.2 SECONDS.
4. DELAY TIME TO R.F. HEAT – 0.5 SECONDS.
5. R.F. HEAT – 225KW, 310 KHz 0.4 SECONDS.
6. QUENCH IMMEDIATELY – 2–1/4% UCON "A" 19 SECONDS 95°F.

FIG. 7
(PREHEAT)
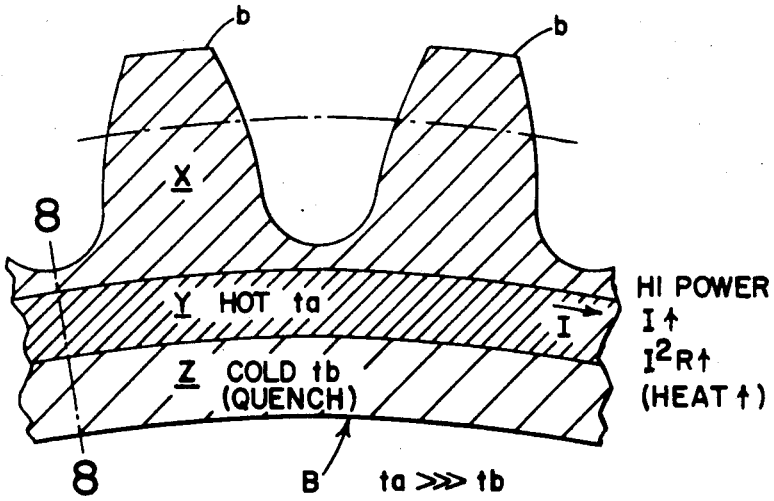
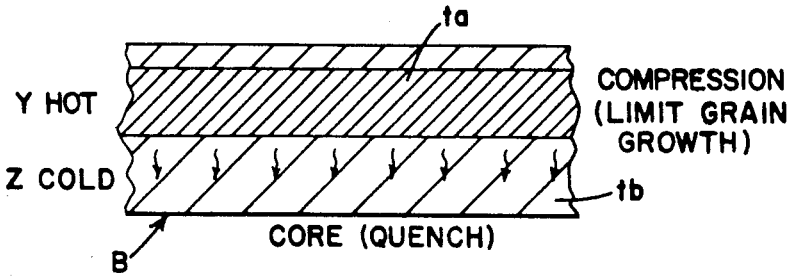
X < Y >> Z
X TOOTH FORM
Y ROOT
Z CORE
FIG. 8

TEMP. D ↑ BY ROOT PREHEATING
TEMP. E ↑ BY FORM PREHEATING

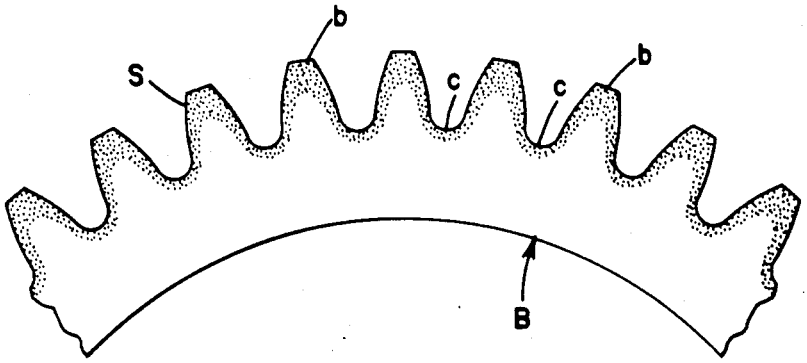
FIG. 16
FIG. 17
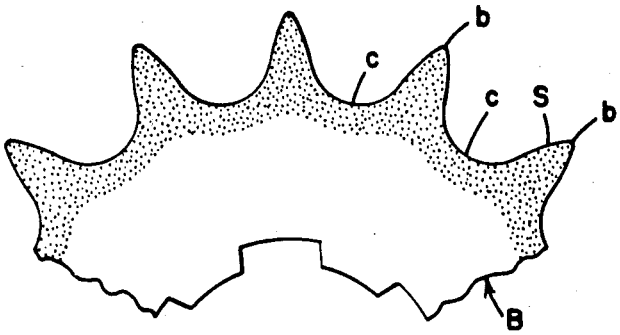

SYSTEM FOR HARDENING GEARS BY INDUCTION HEATING

This is a continuation of application Ser. No. 023,564 filed Mar. 9, 1987 now U.S. Pat. No. 4,749,834 which in turn is a divisional application of Ser. No. 878,186 filed June 25, 1986 now issued as U.S. Pat. No. 4,675,488 on June 23, 1987.

The present invention relates to the art of induction heating preparatory to quench hardening, and more particularly to a method and apparatus for hardening a generally circular disk-like workpiece having outwardly facing teeth, such as gears of the type used in internal combustion engines and motor vehicle transmissions.

BACKGROUND OF INVENTION

The invention is particularly applicable for inductively heating the outer teeth of a helical crankshaft gear of the type used on a motor vehicle and made from 4140 and 4150 steels to a hardened depth of about 0.05 inches uniformly distributed over the outwardly facing surfaces of the gear to produce uniform hardness on the irregular surfaces created by the various outwardly extending teeth. The invention will be described with a particular reference to this application; however, it is appreciated that the invention has much broader applications and may be used for hardening the inner or outer convoluted surfaces of various types of workpieces where the area to be hardened compared to the mass adjacent thereto is substantially less than the area compared to the adjacent mass at the protruding convolution, i.e. generally external gear teeth.

To withstand the wear and contact forces exerted during operation of a high power transmitting gear train, such an internal combustion engine or transmission, it is necessary to provide a hardened outer surface for the various gears constituting the gear train. In accordance with standard technology, the surfaces are hardened while the inner portion or core of the workpiece remains generally soft to present strength and ductility. For many years the surface hardness of gears has been accomplished by a carburizing process wherein the gears are first machined, then immersed in a carburizing media for a substantial length of time to infuse carbon into the surface, and then heat treated so that the carburized outer surface will have a substantially greater hardness than the inner portion or core of the gear. This type of process is lengthy and tremendously expensive. The carburization process does, however, produce gears having an inner tough unhardened mass or core with outer case hardened surfaces for the various teeth extending circumferentially around the outer periphery of the gear. Such costly carburizing processes have motivated many companies to attempt a direct adaptation of relatively inexpensive, easily controlled induction heating technology to the hardening of the outer teeth on gears. Many patents relate to attempts to accomplish this feat. Generally speaking, the only arrangement that has been at all successful has been machines which inductively heat and then quench harden only a few teeth at one time while the rest of the teeth are cooled for the purposes of preventing drawback of previously hardened teeth. By indexing the induction heating mechanism of these machines about the total circumference of the gear, all of the teeth are successively hardened. In this manner, induction hardening of the gear geeth can be accomplished; however, the inductors were extremely complex and expensive. Such induction heating processes have been unsuccessful for mass production since they require a number of heating operations for processing a single gear. Further, such processes involved relatively complex indexing mechanisms and complex induction heating coils or inductors. Pfaffman U.S. Pat. No. 3,446,495 and Masie U.S. Pat. No. 4,251,704 illustrate the type of equipment wherein induction heating has been employed for the purpose of hardening the gear teeth on the circular periphery of a gear. These apparatus do function; however, they have the disadvantages previously described. Assignee of these two patents and other leading manufacturers of induction heating equipment have been seeking for many years an approach that can be used for inductively heating the outer peripheral surfaces of gears by using an encircling inductor so that the gears can be heated by the inductor and then quench hardened immediately thereafter to create case hardening on the outer surfaces of the gear without requiring any modification other than a certain amount of carbon in the steel itself to facilitate hardening of the outer surfaces. By developing such an induction heating concept, the time consuming, expensive carburizing process could be replaced by an apparatus for first inductively heating and then quench hardening the outer surface of the gears. A prior attempt to accomplish this goal is illustrated in Denneen U.S. Pat. No. 2,167,798 wherein a complex apparatus is provided for driving the current created by the inductor into the areas between adjacent teeth for the purposes of inductively heating and then immediately quench hardening the various gears at the same time. This process was not widely adopted and did not replace the carburizing process of gear teeth as previously described.

Immediately after the second World War, it was suggested that induction heating of the outer gear teeth could be accomplished by a dual frequency arrangement wherein a low frequency current would be used for preheating the gear teeth and then a high frequency current could be used for final heating preparatory to quench hardening. Two arrangements for applying this induction heating concept are illustrated in Jordan U.S. Pat. No. 2,444,259 and Redmond U.S. Pat. No. 2,689,900 wherein a single induction heating coil is provided with two frequencies for the purposes of accomplishing deep heating and then surface heating preparatory to quench hardening the teeth of a gear. This process was not successful. Another arrangement was suggested in Kincaid U.S. Pat. No. 2,590,546 wherein the gear is first placed in one induction heating coil driven by a relatively low audio frequency of less than about 15 KHz. Thereafter, the workpiece is shifted into another induction heating coil for heating by radio frequency. After radio frequency heating, the workpiece is shifted into a quenching ring for the purposes of quench hardening the outer heated teeth. This process has substantial merit in that relatively simple induction heating coils and quenching units can be employed for induction heating of the outer surfaces of the gear first by low frequency preheat and then by high frequency final heat to produce a skin effect for creating the hardness pattern around the gear teeth, as illustrated in FIG. 1 of Kincaid U.S. Pat. No. 2,590,546. Even though this process involves simple equipment and known technology, it has not been successfully employed for the purposes of mass producing hardened gears to absorb the stresses and forces created in high power gear trains, such as found in many heavily loaded gear drive trains such as transmissions. Even with these several suggestions on how induction heating can be employed for hardening the teeth of a gear, carburizing is still the basic and common way of accomplishing this hardening process.

Within the last few years, in view of the high price of gas, foreign competition requiring cost reduction and other market conditions, there is now a substantial, tremendous and immediate need for a successful process whereby induction heating of gear teeth can be used for the purpose of providing the gear teeth with hard tough high compression surfaces without causing brittle teeth or various under hardened teeth or over hardened areas between the teeth. To accomplish this objective, it is necessary and critical to produce an induction heating process wherein just before quench hardening the outer surfaces have a preselected temperature to a controlled depth whereas the material immediately behind or below the depth has a substantially lower temperature. Consequently, the quench hardening by liquid will quench harden only the outer surface to the controlled depth and not through harden the teeth. Induction heating of the gear teeth preparatory to quench hardening in the past has resulted in uneven heating and thus uneven hardness depth or pattern. Some of the surfaces have not been hardened at all, others have been hardened through the teeth and some have produced too deep or too shallow hardness at the root between the adjacent teeth. All of these nonuniformities in the hardness pattern are caused by nonuniform distribution of temperature gradients immediately before the liquid quench hardening. The liquid quenching causes rapid cooling. If the temperature is above the transformation temperature, hardening occurs. If the temperature is below the transformation temperature no hardening or reduced hardening occurs. Further, slow cooling prevents proper hardening. At this time, there is a substantial need for an invention in the induction heating field which will create a heat distribution around the teeth of a gear immediately before liquid quench hardening which is uniform so that the resulting hardness pattern after quenching will be uniform. In addition, this induction heating process must be capable of performance at a high rate necessary to substantially reduce the cost required in hardening gear teeth over the cost involved in the processing and equipment now used for carburizing and must use easily controlled simplified inductors.

THE INVENTION

The present invention overcomes the disadvantages of prior attempts to employ induction heating to the process of hardening the protruding convoluted surfaces, such as teeth on a circular gear by accomplishing this objective at a high production rate and in a manner to produce uniform surface hardening from one gear to the next, while using relatively inexpensive induction heating equipment. The method is especially advantageous when compared with the complex carburizing equipment and with other induction heating equipment heretofore employed to heat the peripherally distributed teeth on steel gears preparatory to liquid quench hardening.

In accordance with the present invention there is provided a method of hardening the radially protruding convoluted surfaces of a generally circular, toothed workpiece, such as a gear, which gear is adapted to rotate about a central axis generally concentric with the convoluted surfaces. The teeth of the gear define an outer circle with is clearly recognizable in viewing the gear from the side. The method of the present invention includes providing first and second induction heating coils having inner circular surfaces generally matching, but slightly larger than, the outer surface defined by the tips of the teeth on the gear, locating the gear or workpiece concentrically in the first induction heating coil which is then energized with a first alternating frequency current of less than about 10 KHz at a first power level greater than about 100 KW for a first time period of less than 10.0 seconds, deenergizing the first induction heating coil with the workpiece still therein for a first time delay period of at least about 10.0 seconds and, then, again, energizing this first induction heating coil with a second alternating frequency current of less than about 10 KHz and at a second power level at least as great as the first power level and for a second time period substantially less than the first time period. The invention, as so far described, inductively heats the band at the base or roots of the teeth with a high energy so that a substantial current flows around this circular band at the roots of the teeth. By using low frequency, the heating depth is substantial and the current flow is caused at the lower portion of the teeth and in the roots of the teeth. This preheating process involves two separate and distinct heating operations which are generally at the same frequency, such as 3.0 KHz. The first preheating cycle, in practice, is for approximately 3.0 seconds. The time delay in the total dual cycle preheating allows the heat energy in the teeth to dissipate thereby concentrating the high temperature and energy levels within the band adjacent the roots of the teeth. The next preheating cycle is for a relatively short time of about 1.4 seconds which then heats not only the previously heated roots, but also heats the teeth to a temperature still below the Curie Point temperature. Thus, after preheating which involves a distinct intermediate delay between two high energy cycles causing the high power energy to concentrate in the roots, the gear is immediately and rapidly transferred to a second induction heating coil, which coil or inductor is immediately energized with a radio frequency current of more than about 200 KHz at a third power level still over about 100 KW for a third time period of less than about 1.0 seconds. In this manner, high energy is stored and concentrated adjacent the root portion or band of all the gear. This produces a circumferentially extending band of high energy, high temperature which is at a higher temperature than the teeth themselves and is at a temperature substantially above the temperature of the core below the root portion of the teeth. This temperature profile is very dynamic and unstable. It can not last too long since the energy tends to conduct to the cold core and, to a lesser extent, to the warm teeth. During the radio frequency heating, which occurs for about 0.4 seconds after a shift delay of about 0.4 seconds, the radio frequency current causes a skin effect heating around the surface of the individual teeth and in the root portion between the teeth. This skin effect heating produces a thin skin or layer of high temperature metal substantially above the hardness temperature A3, whereas the metal immediately below the surface of the teeth is drastically below the critical hardness temperature A3. Due to the high concentration of heat energy in the root portion of the teeth, the cold core which is a heat sink mass can not conduct heat from the portion of the gear between the teeth at a rate sufficient to reduce the skin heating below the A3 temperature. This skin portion stays hot. Also, the portion along the outer surface of the teeth is above the hardness temperature A3. The teeth themselves are warm and do not establish a high temperature gradient to cause rapid cooling of the teeth surfaces after the radio frequency heating. The gear is then immediately quenched by flow of liquid from the radio frequency heating coil. In practice an integral quench coil is employed. There is not sufficient time to allow transfer of the gear with the unstable, unique temperature distribution accomplished by using the present invention. Integral quench occurs immediately after the radio frequency has stopped. Indeed, it can occur while the radio frequency is operating for the purposes of avoiding a time when there is a tremendous conduction inertia caused by temperature differentials or gradients for the purpose of drawing the energy from the outer surface into the teeth to cause reduced temperatures before quench hardening.

By using the present invention, wherein a preheating phase uses two low frequency heating cycles separated by a time delay and wherein the particular frequencies and times discussed above are employed, gear teeth can be uniformly heated on their outwardly facing surfaces without through heating the gear teeth which can create brittle teeth upon hardening or without producing soft portions due to lower temperatures before quench hardening. Since the thin layer of high temperature metal immediately adjacent the surface of the teeth is immediately quench hardened, there is no time for extensive grain growth and high compressive forces are created in the teeth surfaces. These high compressive forces imparted to the teeth surfaces are beneficial in the overall operation of the gear teeth.

In accordance with another aspect of the present invention, the gear teeth are immediately shifted into the audio frequency inductor, or first induction heating coil, for stress relieving after a delay of no more than about 1.0 seconds. In this manner, the heat within the gear itself after quenching can be evenly distributed in a general soaking procedure used for stress relieving the previously hardened surface. High production is accomplished without requiring additional heat for the purposes of a subsequent stress relieving process.

The primary object of the present invention is the provision of a method and apparatus for hardening irregular outer surfaces, such as found on gears or sprockets, which method and apparatus produce a uniform hardness pattern at a rapid rate using relatively common induction heating equipment, such as circular inductors and high frequency power supplies with appropriate timing of the various operations.

Yet another object of the present invention is the provision of a method and apparatus, as defined above, which method and apparatus utilizes the concept of heating only the root area below the gear teeth during the preheating cycle that is accomplished by a dual step preheating operation including a preselected delay between the separate steps or cycles.

Still another object of the present invention is the provision of a method and apparatus, as defined above, which method and and apparatus includes a dual preheat operation for the purposes of creating a relatively hot root portion for the gear by using high energy to create a high current flow through the root portion of the gear during the preheat operation.

Yet a further object of the present invention is the provision of a method and apparatus, as defined above, which method and apparatus produces fully transformed martensitic structure at the root portion without overheating the tips of the various teeth constituting the gear. Fully transformed martensitic structure at the root portion provides toughness and wear resistance which is not accomplished by prior methods and apparatus.

Still a further object of the present invention is the provision of a method and apparatus, as defined above, which method and apparatus produces a unique temperature gradient condition immediately prior to liquid quench hardening which allows generally even hardness around the gear and at all outwardly facing surfaces of the gear.

Another object of the present invention is the provision of a method and apparatus, as defined above, which method and apparatus maintains the body of the teeth of the gear relatively cool preparatory to heating by radio frequency immediately before liquid quench hardening.

Another object of the present invention is the provision of a method and apparatus, as defined above, which method and apparatus employs a dual cycle preheating operation performed at relatively low frequencies and high energy levels to reduce the total time necessary for the preheating while obtaining the necessary heat at the root area of the teeth.

Yet another object of the present invention is the provision of a method and apparatus, as defined above, which method and apparatus allows the use of relatively simple circular inductors for the induction heating process.

In accordance with yet another object of the present invention, the preheating operation is accomplished in the invention by utilizing a single turn induction heating coil with a relatively small gap, high power and a frequency in the neighborhood of about 3.0 KHz. This produces a high temperature at the root of the gear teeth at a higher production rate than lower frequencies with a two turn coil.

Still a further object of the present invention is the provision of a method and apparatus, as defined above, which method and apparatus can harden the outer surfaces of gear teeth to such precision that it does not require post finishing.

These and other objects and advantages will become apparent from the following description taken together with the accompanying drawings discussed in the next section.

BRIEF DESCRIPTION OF THE DRAWINGS

FIGS. 6A–6D are graphic illustrations of the hardness pattern obtained by performing an embodiment of the invention as set forth in the tabulation of FIG. 6D with the two turn coil of FIG. 1;

FIG. 7 is a schematic illustration of a portion of the gear illustrating certain temperature characteristics occurring during the preheating operation;

FIG. 8 is a schematic cross sectional view of the area generally defined by lines 8—8 of FIG. 7 and used to illustrate certain heat distribution or gradient characteristics of the present invention;

FIG. 16 is a photograph of a gear processed in accordance with the preferred embodiment of the present invention and polished and etched to illustrate the hardness pattern; and, FIG. 17 is a further photograph similar to FIG. 16 illustrating th use of the present invention on a chain sprocket.

PREFERRED EMBODIMENT OF THE INVENTION

Figure 1:
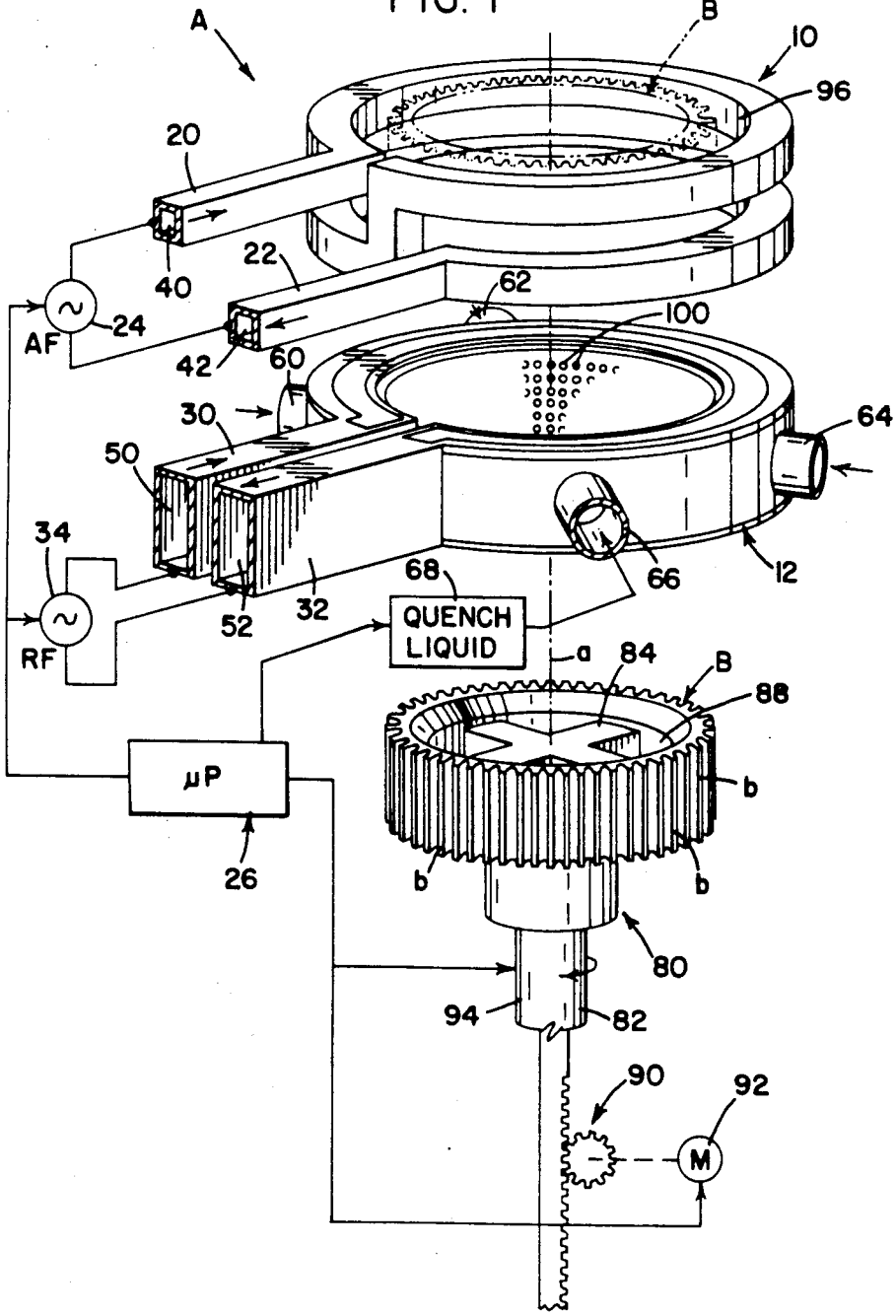
FIG. 1 is a pictorial view illustrating induction heating equipment to be used in performing the present invention, with a two-turn coil used with 1 KHz heating.
Figure 2:
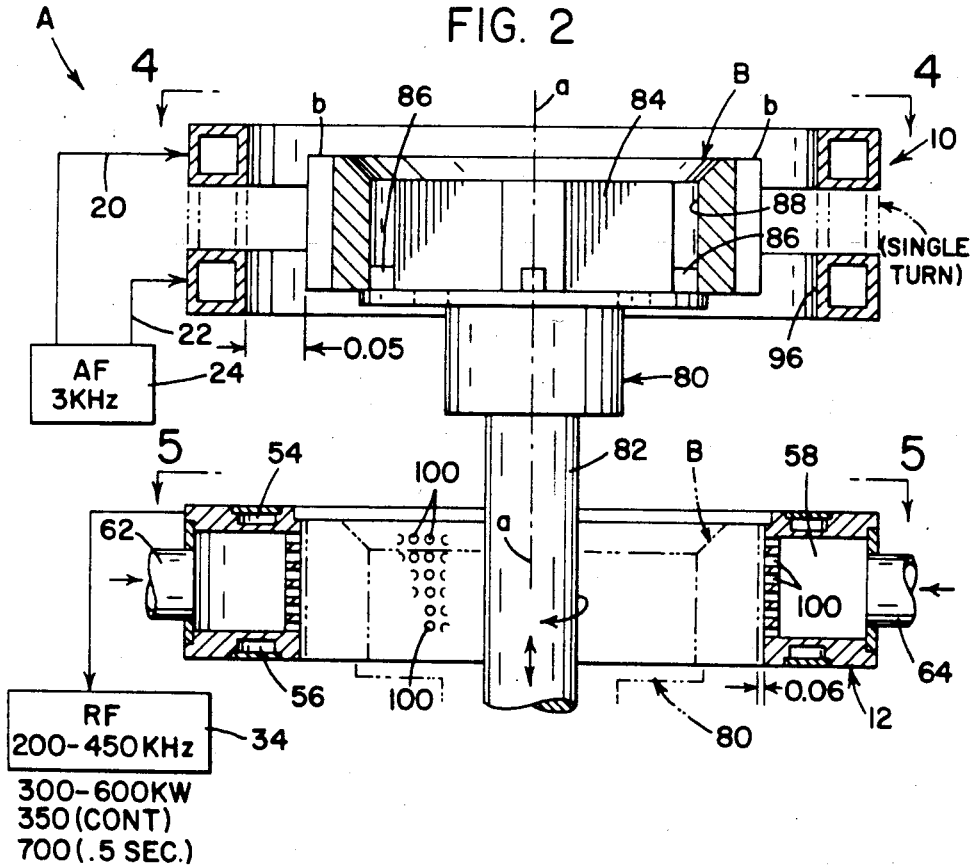
FIG. 2 is an enlarged cross sectional view of the equipment shown in FIG. 1 showing that the preheating coil can be a single turn coil when utilizing 3 KHz frequency.

Referring now to the drawings wherein the showings are for the purpose of illustrating the preferred embodiment or embodiments of the invention and not for the purpose of limiting same, FIG. 1 shows an apparatus A for inductively heating the outwardly facing surface of a generally disk-shaped gear B having outwardly projecting teeth b extending peripherally around the gear in accordance with standard gear design. The tips of the teeth b define an outer circle concentric with rotational axis a and slightly smaller than the inner surfaces of two axially spaced inductors 10, 12. Inductor 12 is an integral quench inductor which can direct quenching liquid from the inductor inward toward axis a for the purposes of immediate liquid quench hardening of previously heated surfaces of gear B. In accordance with somewhat standard induction heating practice, leads 20, 22 of inductor 10 are connected across an alternating power supply 24, which in practice is a solid state inverter. An appropriate timer feature of microprocessor 26 energizes and deenergizes coil 10 by power supply 24 at power and for times needed to perform the present invention. Alternating frequency current from power supply or inverter 24 is directed by leads 20, 22 around inductor 10, which in FIG. 1 is illustrated as a two turn inductor used for 1 KHz heating of the FIG. 6 embodiment; however, in the preferred embodiment schematically illustrated in FIG. 2, the inductor may be a single turn inductor spaced outwardly about 0.05 inches from the outer circle of gear B and adapted to heat the gear as it is rotated within the single turn inductor. Leads 30, 32 are connectd across power supply 34 which, in the preferred embddiment, is an oscillator having a frequency generally over 200 KHz and is controlled in timing cycles by microprocessor 26. Alternating high frequency or radio frequency current from power supply 34 is directed across leads 30, 32 and around integral quench inductor 12 for the purposes of inductively heating gear B when it is rotated or fixed within inductor 12. Coolant liquid, in accordance with standard practice, is directed through inlet 40 and outlet 42 of inductor 10 for the purposes of maintaining the inductor at a reduced temperature during the heating operation. In a like manner, inlets 50, 52 of integral quench inductor 12 are adapted to maintain the leads 30, 32 cool as well as passing water through cooling passages 54, 56, as best shown in FIG. 2. Quenching liquid is directed into internal quenching passage 58 by a plurality of axially spaced quench liquid inlets 60, 62, 64 and 66 supplied by a standard unit schematically illustrated as block 68. Gear B is supported on a reciprocated and rotatable support structure 80 which, schematically, includes a drive rod 82 with an upper spider 84 having outwardly projecting cams 86 to engage the inner surface 88 of gear B. Rack and pinion 90 is driven by motor 92, schematically, to drive support 80 in a vertical direction between a first position within inductor 10 and a second position within inductor 12 upon command from microprocessor 26. Thereafter, the gear is moved into the position shown in FIG. 1 for loading and unloading of gear B. Axial spacing of the inductors is relatively short or small and allows movement of gears B by support 80 within substantially less than 0.5 seconds. A motor 94 rotates rod 82 in accordance with standard practice and upon command of microprocesor 26.

Figure 3:
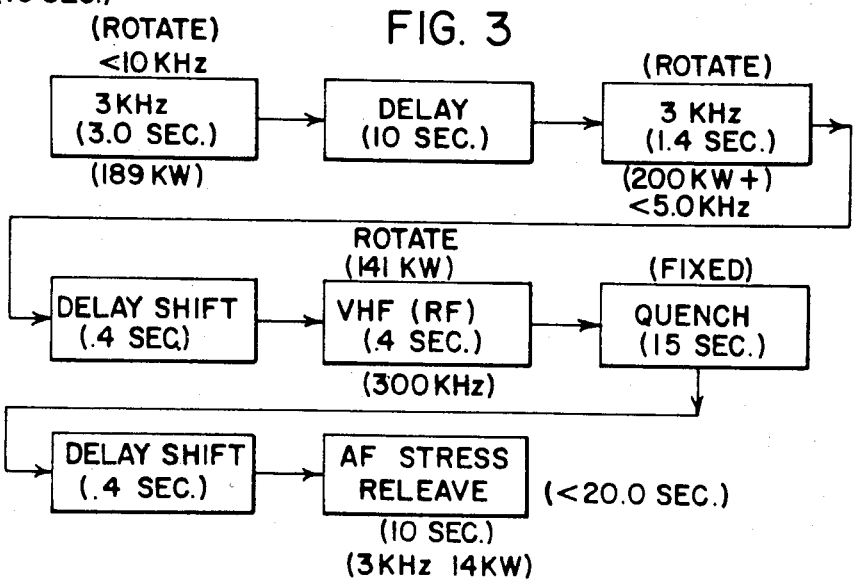
FIG. 3 is a block diagram setting forth the various steps used in performing the preferred embodiment of the present invention.
Figure 4:
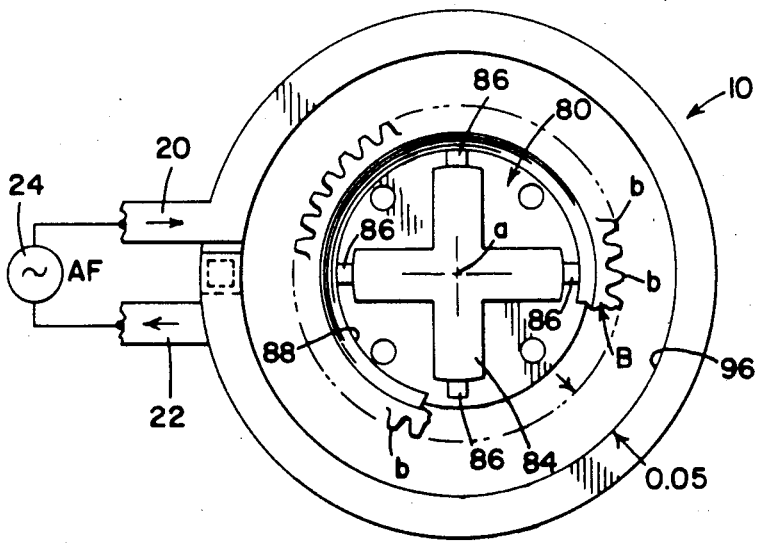
FIG. 4 is a cross sectional view taken generally along line 4—4 of FIG. 2.
Figure 5:
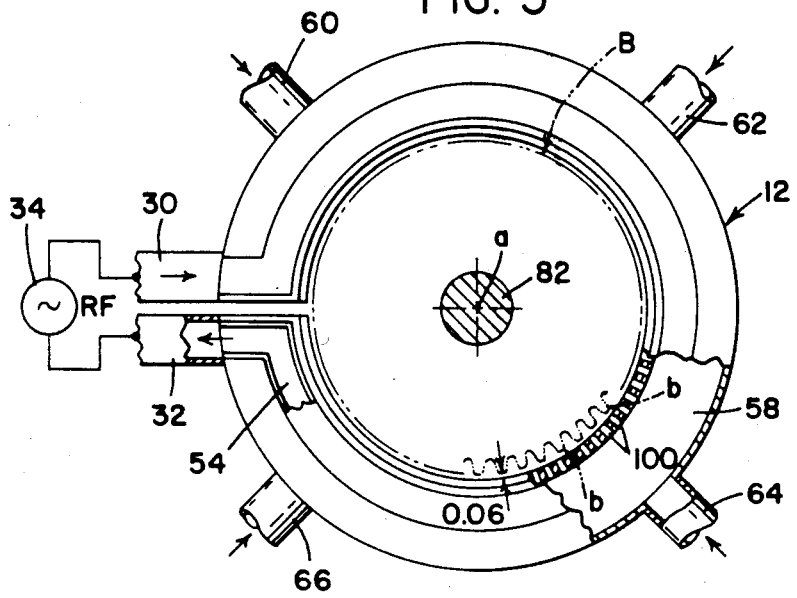
FIG. 5 is a cross sectional view taken generally along line 5—5 of FIG. 2.

Referring now to FIGS. 2–5, 7–10 and 12–15, the method and apparatus in accordance with the present invention will be described in detail, together with certain operating characteristics and accomplishments of the apparatus and method. After gear B is loaded onto the upper portion of support 80, it is indexed by the microprocessor actuating motor 92. The first position is shown in FIGS. 2 and 4. The outer circle defined by the tips of teeth b is only slightly spaced from the inner surface 96 of inductor 10. In practice, the inductor is a single turn inductor with the spacing of about 0.05 inches. In this first position, the alternating frequency of power supply 24 is directed through leads 20, 22 to inductor 10. In the preferred embodiment, the frequency of power supply 24, which is a solid state power supply, is 3.0 KHz nominal. While gear B is rotated by motor 94 at the command of the microprocessor, power supply 24 supplies over 100 KW of energy at 3.0 KHz. In practice, the high power of the initial preheat cycle is 189 KW. This preheat cycle continues for 3.0 seconds.

Figure 12:
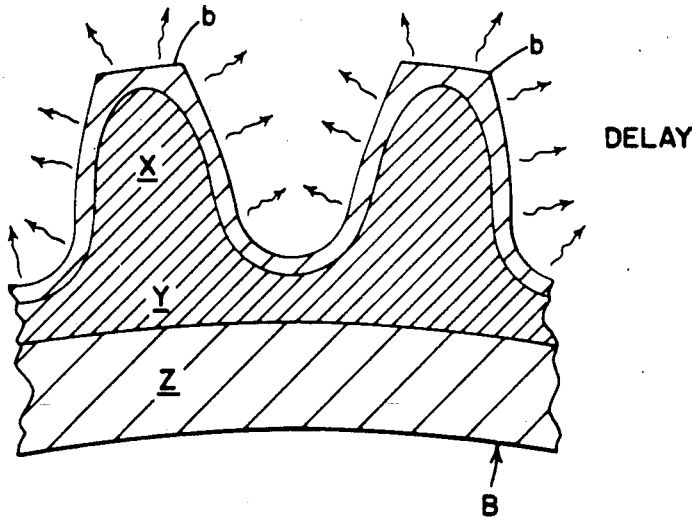
FIG. 12–15 are views similar to FIGS. 9 and 10 to be employed for the purpose of describing certain characteristics and features of the preferred embodiment of the present invention.
Figure 13:
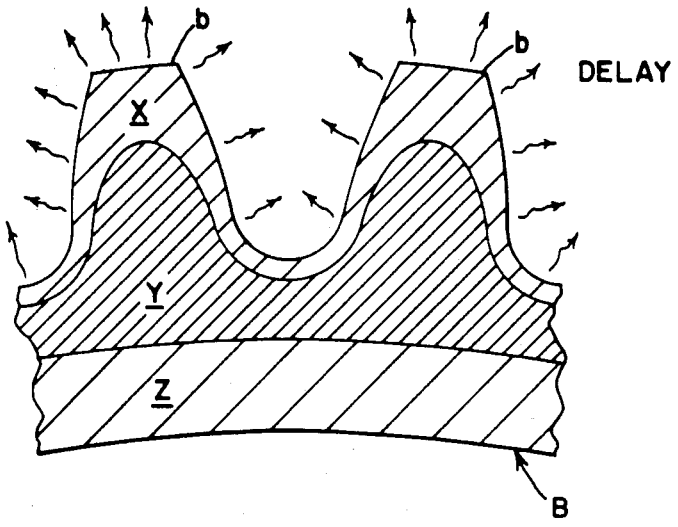
Figure 14:
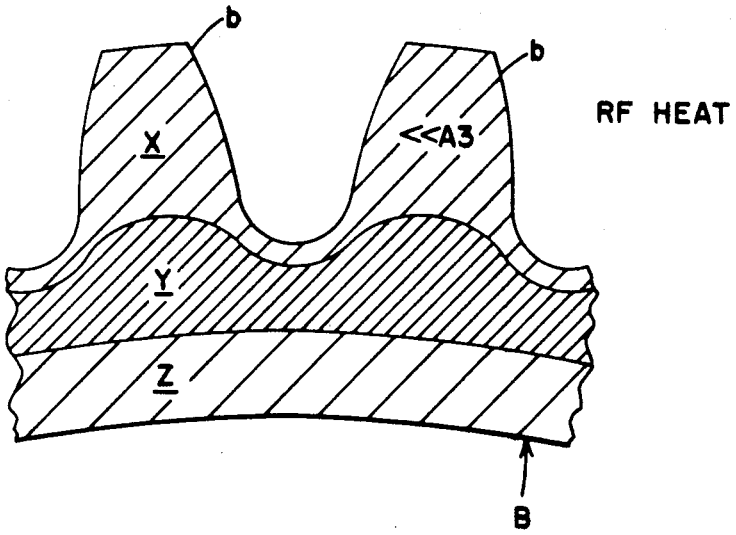

Referring now to FIG. 7, this first high power cycle of relatively low frequency current in single turn inductor 10 causes heat to flow generally along the root area of teeth b, as shown in FIG. 7. This area Y is the root area. By having a high power, and relatively low frequency, the current I in this band is quite high compared to current flow in the rest of gear B. Ths high current flow causes heat to be concentrated in the annular band Y. The band has a relatively high temperature while the inner core area Z of the gear is relatively cold. Since the teeth areas X are between band Y and inductor 10, these areas are also heated by induction heating. During this induction heating, the teeth and band are both heated to a relatively high temperature. Thereafter, the invention involves a delay of at least 10 seconds. The characteristics of this delay are illustrated in FIGS. 12 and 13. During the delay, the energy in the teeth areas X is dissipated by radiation, as indicated by the radiated arrows in FIGS. 12 and 13. Consequently, the area of high temperature shrinks downwardly into an area generally comprising band Y at the root of the teeth. As the delay continues, the modular portions of high temperature in area X shrink since energy is dissipated by radiation and conduction from the teeth b of gear B, as shown in FIG. 13. After the delay of 10 seconds, the workpiece or gear continues to rotate and a second preheat cycle is initiated at 3 KHz for 1.4 seconds. The power of this preheat is substantially the same as the power used in the first preheat cycle. In this instance, the power level is over about 200 KW. When this second preheating occurs, the temperature profile shown in FIG. 13 is somewhat maintained as shown in FIG. 14. The root zone or band Y is still hot and at a temperature at least near the A3 temperature, but the temperature can be slightly below that critical temperature. The teeth themselves are at a temperature substantially less than the A3 temperature. This heating gives a profile, shown in FIG. 14. This high heat profile is unstable. The temperature in the teeth is fairly high, in the neighborhood of approximately 1,000° F. The root temperature in the area Y is in the neighborhood of generally 1250° F. All of this heating occurs while the core Z is at a low temperature in the neighborhood of about 750° F. Should a substantial time elapse, conduction and radiation would generally stabilize the temperatures and dissipate the unique temperature profile shown in FIG. 14.

Figure 15:
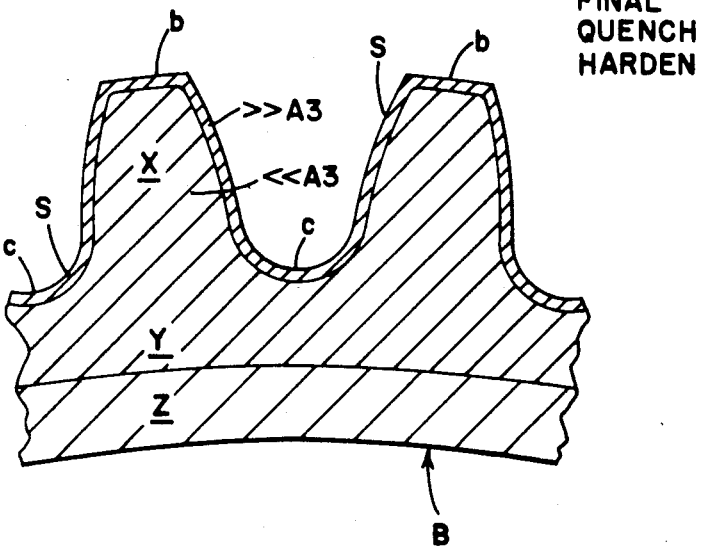

Immediately after the second preheat cycle, the gear is indexed downwardly to the lower inductor 12. This index is a rapid downward index taking less than about 0.5 seconds. In practice, this shift time is 0.4 seconds. Thus, the high temperature profile shown in FIG. 14 is maintained at the time of radio frequency heating by inductor 12. At this time, a frequency substantially greater than 200 KHz is employed. This frequency, in practice, is 300 KHz at 141 KW for 0.4 seconds. Thus, skin effect heating occurs as shown in FIG. 15. The temperature of the root areas beteen the teeth c is maintained by the high temperature within the heated band Y. The energy in skin S can only dissipate by radiation since the high temperature of the band Y does not provide a high gradient for mass quenching. The teeth themselves are at a relatively high temperature so that the radio frequency raises the temperature of skin S, which has a depth determined by the frequency of power supply 34. The resistivity of the teeth areas, which is a factor controlled by temperature of the metal, prevents conduction through the teeth.

Figure 9:
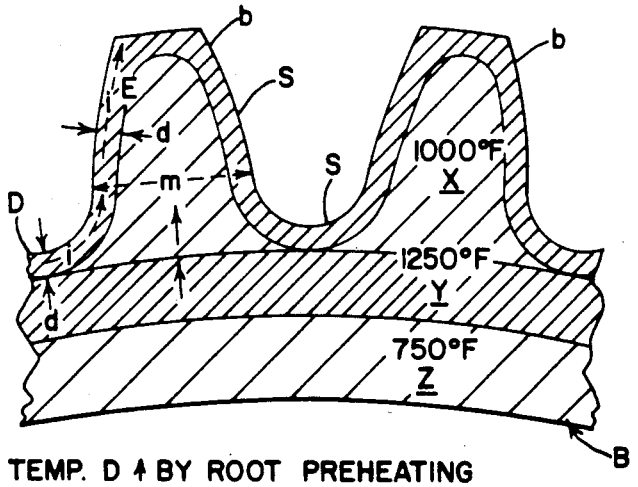
FIG. 9 is a schematic view of adjacent teeth having certain temperature gradient characteristics to be used in explaining aspects of the present invention.
Figure 10:
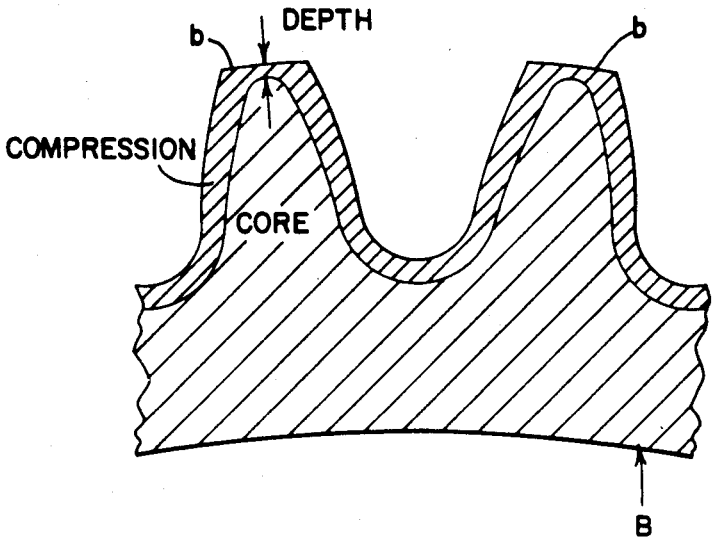
FIG. 10 is a view similar to FIG. 9 and also employed for the purpose of describing the final hardness pattern obtained by hardening the gear in accordance with the present invention.
Figure 11:
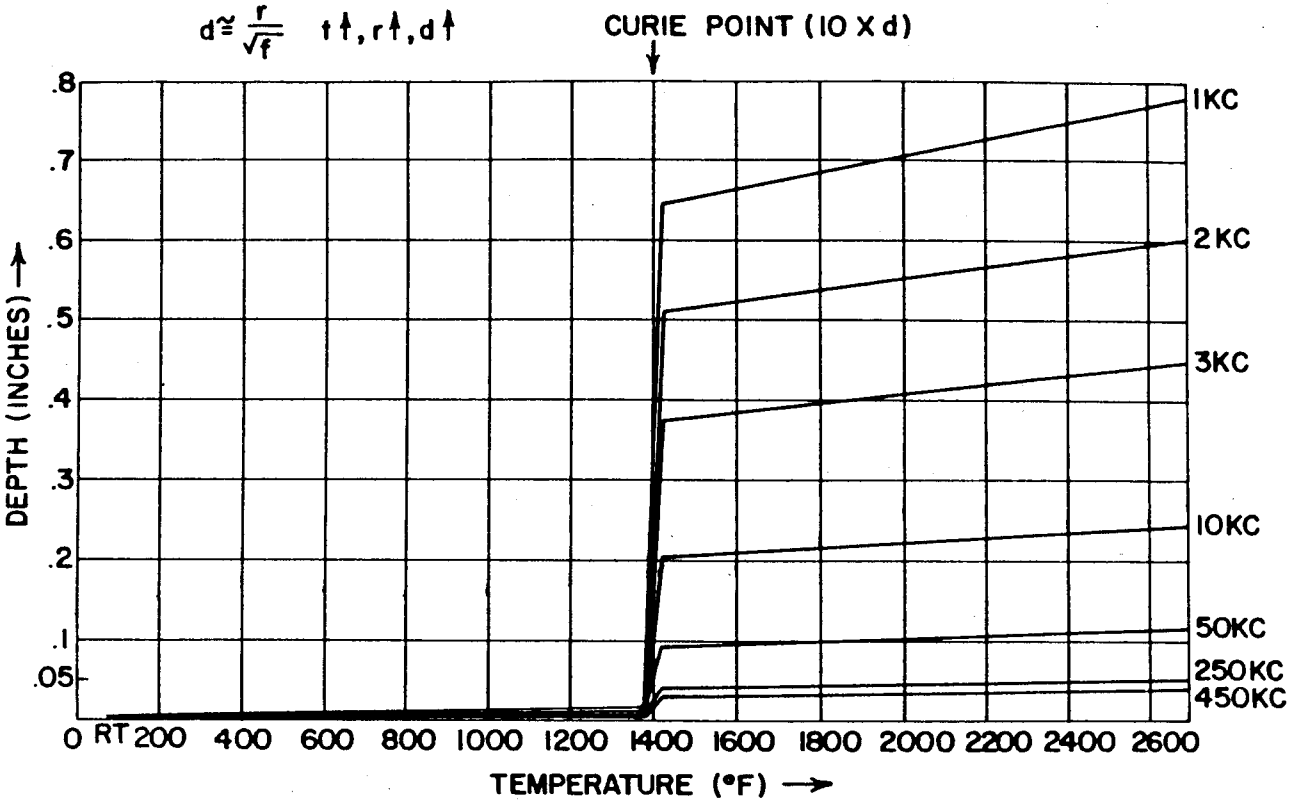
FIG. 11 is a graph showing certain electrical characteristics in induction heating that explain concepts of the present invention.

The final heating gradient after radio frequency heating is shown generally in FIG. 9. Liquid is passed through the integral quench openings 100 from passage 58 by operation of unit 68. This liquid flow immediately quench hardens the outwardly facing surfaces or skin S of gear B. This liquid quench hardening occurs immediately after the radio frequency heating cycle of 0.4 seconds. At this time, gear B is fixed by stopping motor 94. The teeth do not rotate to pump the quenching liquid away from the surfaces. This quiescent liquid quenching provides an immediate quench hardening to produce the hardness pattern corresponding to the final skin configuration as shown in FIG. 15. The hardness pattern is illustrated in FIG. 10. Just before hardening, the heating profile is shown in FIG. 9. The depth d is the reference depth having characteristics shown graphically in the graph of FIG. 11. Reference depth d increases by a factor 10 at the Curie Point of the metal, which is in the neighborhood of 1400° F. Thus, depth d in the root area between teeth is determined by the high frequency or radio frequency heating and the fact that band Y is at a temperature that skin S moves to beyond the Curie Point at once. This give a deep pattern for the skin. Since the area or band Y is at a high temperature, there is no tendency for the temperature in the root area to be reduced drastically by internal mass conduction. Thus, the temperature at the root area increases drastically during the short radio frequency heating cycle and is immediately quenched to produce a deep hardness pattern in the root area, as shown graphically in FIG. 15.

Since the temperature in the teeth area X is relatively high (1000° F.) as illustrated in FIG. 9, the resistivity in this area is high. This prevents short circuiting through the teeth, as illustrated by the horizontal line m. Thus, the current i, caused by the radio frequency heating, circulates around the teeth to heat, by the resistance heating effect, only skin S of the teeth to a depth d determined by the frequency of the radio frequency heating process and the temperature, which temperature affects the resistivity of the material adjacent skin S of the teeth. Thus, by the dual preheating operation, which first creates a substantial high temperature band in the root area of the teeth and then a further high temperature profile upwardly into the teeth immediately before high frequency heating, the high frequency heating effect maintains itself generally at the reference depth d and allows circulation around the outwardly facing surfaces of teeth B. This heating concept produces a uniform final heat preparatory to immediate quench hardening by rapid flushing of liquid through the many openings 100 from quenching chamber 58 of the integral quench inductor 12 upon command from the microprocessor.

Referring now to FIGS. 8 and 10, since the core Z is at a relatively low temperature, this core has a temperature tb, which is different from temperature ta of the hot band metal Y. Since the preheating operation has pumped in or caused a substantial heat energy in the band Y, the upper portion X, which is at a lower temperature, has no lower area that forms a heat sink from which to remove the temperature from the inner portion of teeth b. The temperature actually flows from band Y toward portion X during the radio frequency heating cycle. This allows the temperature of heated outer skin S to remain high immediately before quenching. Since quenching occurs immediately, i.e. within less than 1.0 seconds after the final radio frequency heating, there is no time for grain growth in the outer skin and there is no temperature sink to cause this grain growth. This, high compression occurs in skin S, which is heated by the radio frequency and then immediately quench hardened by stopping the rotation of the workpiece and flushing coolant liquid into the area of the teeth from the integral quench inductor 12. By producing the hot root band Y, the cold core Z does not produce a heat sink which draws the temperature of the radio frequency heating out. In addition, band Y allows the teeth themselves to be maintained at relatively high temperatures to increase the resistivity in the teeth area X to prevent short circuiting through the teeth themselves during the radio frequency heating cycle. All of these advantages cause skin S to be concentrated and immediately quenched into a hardened surface which is in compression. This feature, illustrated in FIG. 8, is an advantage not obtained by other processes attempting to accomplish the hardening of gear teeth by induction heating.

The cycle so far described is schematically illustrated in block diagram and the parameters are generally set forth on FIG. 3. The low frequency preheat is accomplished by 3 KHz or 1 KHz. The delay of 10 seconds allows the temperature to stabilize within the band Y for the purposes explained earlier. The diameter of the gears in practice varies between 2.0 inches and 10 inches. The power which is high power in the induction heating field, changes according to the mass of the gears. Lower powers are required for smaller gears. It is necessary to pump into or create in the area Y a high heat profile. This is then accentuated by the second preheat so that the teeth are at an elevated temperature while the core is at a low temperature. The delay concentrated the high temperature profile. By having high energy in the root area of the teeth, the radio frequency skin effect in the root area produces a high temperature above the A3 temperature or hardness temperature which remains for a sufficient time for quench hardening. Without the production of the controlled high temperature band in the root portion, there is a tendency for the temperature of the areas between the teeth to decrease below the hardness temperature before they can be quench hardened, even when liquid quenching is done immediately. Thus, the use of two preheats with a relatively long delay inbetween produces the desired energy within the band Y for the purposes of subsequent controlled hardening. This high energy band prevents the teeth from becoming quite cold by internal mass quenching and also holds the temperature in the root area subsequent to high frequency heating for the purposes of producing the pattern desired for these particular workpieces.

Referring now to FIGS. 6A–6D, a slight modification of the preferred embodiment of the present invention is illustrated. In this embodiment, the actual hardness patterns for the teeth at one axial side, at the center and at the other axial side are set forth. These hardness profiles are accomplished by the present invention using the hardening cycle illustrated in FIG. 6D. The preheating cycles are accomplished at 1 KHz with a delay of 25 seconds inbetween. Still a short delay occurs after the preheating operation and before the radio frequency heating, to prevent the delicate heat profile, shown generally in FIG. 14, from dissipating prior to the actual radio frequency heating. Quenching by liquid is immediate and lasts for 19 seconds. The quenching liquid is illustrated as 2¼% Ucon "A" polymer.

This second embodiment is illustrated to show certain ranges allowed in performing the present invention, even though the previously described method is preferred since it accomplishes the desired results within a processing cycle time that is more compatible with high production in motor vehicle environments.

The photograph in FIG. 16 is an actual gear hardened in accordance with the preferred embodiment of the present invention showing the hardness profile schematically illustrated in FIG. 15. A chain sprocket utilizing the present invention has a hardness pattern as illustrated in the photograph of FIG. 17. Although many processes are alleged to accomplish these results, in practice none of them have been successful and commercially feasible as is the present invention.

The thickness of the teeth and the axial length of the inductors is approximately 1.4 inches. Rotation of the workpiece during the heating operation avoids any adverse effect by the fishtail between the two input leads of the single turn inductors. The example of the preferred embodiment includes a gear having an outer diameter of 5.27 inches whereas the internal diameter of the inductors is approximaely 5.230. There is a relatively close coupling between the teeth and the inductors. The radio frequency heating gap is 0.061 while the preheating gap is 0.050. To accomplish these gaps, the internal diameter of the integral quench is 5.250 inches while the internal diameter of single turn preheat inductor 10 is 5.230 inches. In accordance with the present invention, the tip area is warm while the core Z is cold. Inbetween these two areas is a relatively hot root area or band Y created by high current flow during both preheating cycles. In the past, preheating was followed by a relatively long soaking time which allowed the teeth area X and the band Y to be at a uniform or stabilized temperature. Using 1 KHz with a two turn coil, the differential in temperatures was not as good as in the preferred embodiment. For that reason the 3 KHz preheating with a single turn coil is preferred. This combination causes heating of the root area or band Y alone, without substantial heat in the teeth area. In accordance with the invention, a single turn coil 10 is used with a very small gap.

The invention has been described with respect to hardening of the outer teeth of a circular gear with inductor coils and quench units surrounding the outer circle. The same concept could be used for the internal gear teeth of the type used in the outer gear of a planetary gear train. In that case, the circle to define the outer extremity is an inner circle and the surfaces of the inductor coils and quench bodies fit inside the gear and spaced in the same manner as so far described. Indeed, this process is applicable to any convoluted surface having a number of successive protrusions where the area to be hardened compared to the mass adjacent thereto is substantially less between the protrusions than the area compared to adjacent mass at the protruding convolution, i.e. protrusions, gear teeth, chain pulley teeth, etc.

The 10 KHz frequency preheating and the number of preheating cycles using this low frequency is a difference in kind from the final heating operation by radio frequency which can only heat to a limited depth which is controlled by the unique preheating process. The preheating is preferably a dual cycle; however, three or more cycles may be used as long as the concept of the special heat profile preparatory to final radio frequency heating is maintained.

The selection of particularly the preheat frequency and its technique of application, i.e. numbers of cycle, and/or frequency are a function of the root to tip surface area to mass relationship, which very similarly equates to diametral pitch in a circular gear. The preheat frequency and cycle selection is somewhat dependent on such diametral pitch. Consequently, certain changes in the preferred embodiment can be made to create the necessary thermal reserve in the root area and to apply sufficient energy to raise the tooth from temperature and, consequently, its resistivity so that the current of the final heating frequency will link through the root and not short circuit itself within the tooth form. This second requirement increases depth of current flow and increases the hardened depth at the pitch line.

In gears for heavy loads, the high wear and unit loading occurs generally around the pitch diameter on the flank portion of the tooth. Therefore, in this area, one must have high hardness and surface strength which comes with hardness increases to tolerate the wear and scuffing action. Along with this it is beneficial to have relatively high compressive stresses to handle the high unit loading or hertzian stress requirement. The contour pattern requirement in that level of compressive stresses is dependent upon the ratio of surface harden depth to core or mass in the unhardened area. A through hardened tooth would have actual tensile stresses on the contact surface where compressive forces are needed. This analysis shows that the ratio of core or mass in the tooth form determines the level of compressive stresses at the pitch line, which is dictated by the operating requirements of the particular gear design. Use of the present invention satisfies these requirements.

Root hardness and particularly compressive stress level determines the tooth bending load capability. On relatively heavily loaded gears, the cantilevered loading of the individual tooth determines the stress at the root. Since there is no contact in the root area, hardness is not a requirement other than recognizing that increased hardness increases material strength in the root area. Both the characteristics of pitch line hardness and root area hardness are satisfied.

A single turn inductor can be used with a 1 KHz preheating cycle; however, this produces a deeper case depth in the root area than with the preferred 3 KHz preheating cycle.

Having thus described the invention, the following is claimed:

1. An apparatus for hardening the radially, outwardly facing surfaces of a generally circular toothed workpiece adapted to rotate about a central axis generally concentric with said outwardly facing surfaces, said surfaces defining an outer circle by the tips of said teeth of said workpiece, said apparatus comprising:

(a) first and second induction heating coils having inner circular surfaces generally matching and slightly larger than said outer circle of said workpiece;

(b) motor means adapted to be associated with said workpiece for locating said workpiece concentrically in said first induction heating coil;

(c) first power means associated with said first coil for energizing said first induction heating coil with a first alternating frequency current of less than about 5.0 KHz and a first power level greater than 100 KW;

(d) microprocessor means associated with said first power means for activating said first power means to energize said first coil for a time period less than about 10.0 seconds and deenergize said coil with said workpiece therein for a first time delay period of at least about 10 seconds;

(e) said microprocessor means effective to again actuate said first power means to energize said first induction heating coil with a second alternating frequency current of less than about 5.0 KHz and a second power level at least as great as said first power level and for a second time period substantially less than said first time period to produce an unstable temperature band located radially inwardly from said tips, said tips being at a higher temperature than the core of said workpiece but less than the critical temperature of said workpiece;

(f) said motor means controlled by said microprocessor means effective to said workpiece concentrically into said second induction heating coil after a second delay time no more than about 1.0 seconds;

(g) second power means associated with said second coil and actuated by said microprocessor means for energizing said second induction heating coil with a radio frequency current of more than 200 KHz at a third power level over 100 KW said microprocessor means further effective to actuate said second power means for a third time period of less than about 1.0 seconds; and, (h) quench means within said second induction heating coil controlled by said microprocessor means for immediately spraying a quenching liquid against said surfaces after said third time period while said workpiece is in said second induction heating coil to quench said workpiece without adverse grain growth.

2. A system for hardening the surfaces of closely spaced, successive protrusions and the connecting portions between said protrusions on a convoluted workpiece with a central core where the ratio of area to quench mass is substantially lower in said connecting portions than in said surfaces of said protrusions, said system comprising:

(a) induction heating coil means adapted to surround said workpiece for heating said workpiece by induction;

(b) power supply means connected to said induction heating coil means for supplying a power greater than 100 KW to said induction heating coil means to cause said induction heating coil means to heat said workpieces;

(c) microprocessor means connected to said power supply means for actuating said power supply means for a first predetermined time period followed by interrupting said power supply means for a second predetermined period, said first and second periods defining a cycle, said microprocessor means effective to actuate a predetermined number of cycles so that a circular band of an anticipated configuration interconnecting said connecting portions from the central core is heated to an unstable temperature substantially greater than that of said protrusions forming the quenching mass for said surfaces, said protrusions being at temperature greater than the temperature of said core but less than the critical temperature of said workpiece;

(d) quench means associated with said induction heating means and actuated by said microprocessor means after said third time period and before dissipation of said unstable temperature band for supplying quenching liquid as a spray against said convoluted surfaces for quenching said workpieces whereby a plurality of workpieces can be rapidly processed in succession.

3. The system of claim 2 wherein said first time period is less than 10 seconds; said second time period is greater than 10 seconds and said third time period is less than about 1 second.

4. The system of claim 3 wherein said means for immediately inductive heating occurs before said circular band has substantially dissipated its heat.

5. The system of claim 4 wherein said means for induction heating occurs at an audio frequency.

6. The system of claim 5 wherein said temperature of said circular band is at or near the critical hardening temperature of said surfaces.

7. The system of claim 2 wherein said induction heating means includes a first and second induction coil axially spaced from one another;

said power supply means includes a first inverter operating at audio frequency to power said first induction coil and a second inverter operating at radio frequency to power said second coil;

said system further including motor means associated with said workpiece to drive said workpiece from said first coil to said second coil;

said microprocessor means being effective to actuate said motor means and move said workpiece to said second coil after completing said predetermined number of cycles; and said quench means is located within said second coil and is actuated by said microprocessor means to immediately quench said convoluted surfaces after said third period whereby grain growth in said convoluted surface is minimized.

* * * * *

UNITED STATES PATENT AND TRADEMARK OFFICE

CERTIFICATE OF CORRECTION

PATENT NO. : 4,785,147

DATED : November 15, 1988

INVENTOR(S) : George M. Mucha, George D. Pfaffmann, Donald E. Novorsky

It is certified that error appears in the above-identified patent and that said Letters Patent is hereby corrected as shown below:

Column 1, line 26, cancel "a"; line 37, after "such" insert--as--. Column 4, line 3, "with" should read--which--. Column 7, line 24, cancel "photograph" and substitute-- fragmentary view--; line 26, cancel "polished and etched to illustrate" and substitute--- showing--; line 28, cancel "further photograph" and substitute-- plan view--; line 29, "th" should read--the--; line 65, "embddiment" should read--embodiment--. Column 9, line 68, after the period (.) insert-- See Fig. 11.--. Column 10, line 36,actual; after "Figs." insert-- 7,--; line 52 (actual), "This" should read --Thus--. Column 11, line 57, "photograph" should read--view--; cancel "is an actual" and substitute-- shows a--; line 62,"photograph" should read--view--. Column 12, line 13, "Inbetween" should read--In between--. Column 13, line 68, after "to" insert --immediately transfer--. Column 14, line 25, after "to" insert--closely--; line 32, "workpieces" should read--workpiece--; line 42, "the" should read-- said--; line 45, after the semi-colon (;) insert--said microprocessor means further effective after applying a predetermined number of cycles to actuate said power supply means for immediately inductively heating said convoluted surfaces with a radio frequency for a third time period, said third time period less than said first time period; and--.

Signed and Sealed this

Twenty-fourth Day of July, 1990

*Attest:*

HARRY F. MANBECK, JR.

*Attesting Officer*

*Commissioner of Patents and Trademarks*